United States Patent [19]

Reid, Jr.

[11] 4,272,091

[45] Jun. 9, 1981

[54] ROLLER SKATE

[76] Inventor: Thomas J. Reid, Jr., 506 Morley Pl., Elmira, N.Y. 14904

[21] Appl. No.: 37,254

[22] Filed: May 9, 1979

[51] Int. Cl.[3] ..... A63C 17/04

[52] U.S. Cl. ..... 280/11.28; 280/11.19

[58] Field of Search ..... 280/11.28, 11.27, 11.26, 280/11.19, 11.1 R

[56] References Cited

U.S. PATENT DOCUMENTS

| | | | |
|---|---|---|---|
| 138,018 | 4/1873 | Gregg | 280/11.19 |
| 301,676 | 7/1884 | Clark | 280/11.19 |
| 1,393,813 | 10/1921 | Muck | 280/11.19 |
| 2,190,316 | 2/1940 | Harris | 280/11.26 |
| 2,195,348 | 3/1940 | Wiseley | 280/11.27 X |
| 3,306,623 | 2/1967 | Weitzner | 280/11.19 X |

*Primary Examiner*—John J. Love
*Assistant Examiner*—Milton L. Smith
*Attorney, Agent, or Firm*—Seidel, Gonda, Goldhammer & Panitch

[57] ABSTRACT

The roller skate is designed for outdoor skating with balancing control being attained by a pair of center wheels, a front wheel and a rear wheel. Center wheels are on opposite sides of an imaginary center line while the front and rear wheels are aligned with each other along said imaginary line. All wheels are of the same size. A discrete shock absorber is provided for each of the front and rear wheels with a common shock absorber being provided for the center wheels.

10 Claims, 4 Drawing Figures

ROLLER SKATE

BACKGROUND

Roller skates traditionally have a pair of front wheels and a pair of rear wheels. Roller skates for use outdoors are generally of the clamp-on type whereas roller skates for indoors are generally of the shoe type. Roller skates of the shoe type for use indoors are not satisfactory for outdoor skating on pavements, sidewalks, parking lots and the like.

I have found that better balance and control for outdoor skating is attained by providing only one front wheel, one rear wheel aligned with the front wheel, and a pair of center wheels with all wheels of the same size.

U.S. Pat. No. 3,306,623 teaches a shoe having wheels removably attached thereto with the front and rear wheels of different widths, and with three wheels being in the sole portion of the shoe. Thus, in said patent, the pair of wheels on a common axle are not positioned so as to be equidistant from the front and rear wheels.

It is known from U.S. Pat. No. 1,393,813 to provide a pair of center wheels equidistant from front and rear wheels which are aligned with one another. In U.S. Pat. No. 1,393,813, the front and rear wheels are substantially smaller than the center wheels whereby the skate does not roll on all four wheels at the same time. As will be apparent from FIGS. 1 and 2 of the last-mentioned patent, the front wheel is wider than the rear wheel, the center wheels are not beneath the shoe, and the rear wheel is supported by a spring bracket which yields under pressure to apply friction when it is desired to stop.

The skate of the present invention has features in common with skates in each of said patents. However, the skate of the present invention differs substantially from the skates in each of said patents as will be made clear hereinafter.

SUMMARY OF THE INVENTION

The present invention is directed to a roller skate for skating outdoors. The skate includes a shoe for receiving therein a person's foot. The shoe has a bottom sole. A frame is attached to said bottom sole.

A front wheel is rotatably supported by a brace depending from the frame adjacent to and beneath the toe of the shoe. A rear wheel is rotatably supported by a brace depending from the frame adjacent to and beneath the heel of the shoe.

A pair of center wheels are rotatably supported on a common axis by a brace depending from the frame at a central location between and substantially equidistant from the axes of rotation of said front and rear wheels. All of the wheels are of the same size and are at the same elevation for simultaneous rolling contact with a support surface. The front and rear wheels are aligned.

A first shock absorber is provided on the frame for the center wheels. A second shock absorber is provided on the frame for the front wheel. A third shock absorber is provided on the frame for the rear wheel.

It is an object of the present invention to provide a novel roller skate for outdoor skating while producing better results for balance and control as well as comfort while skating over rough surfaces.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
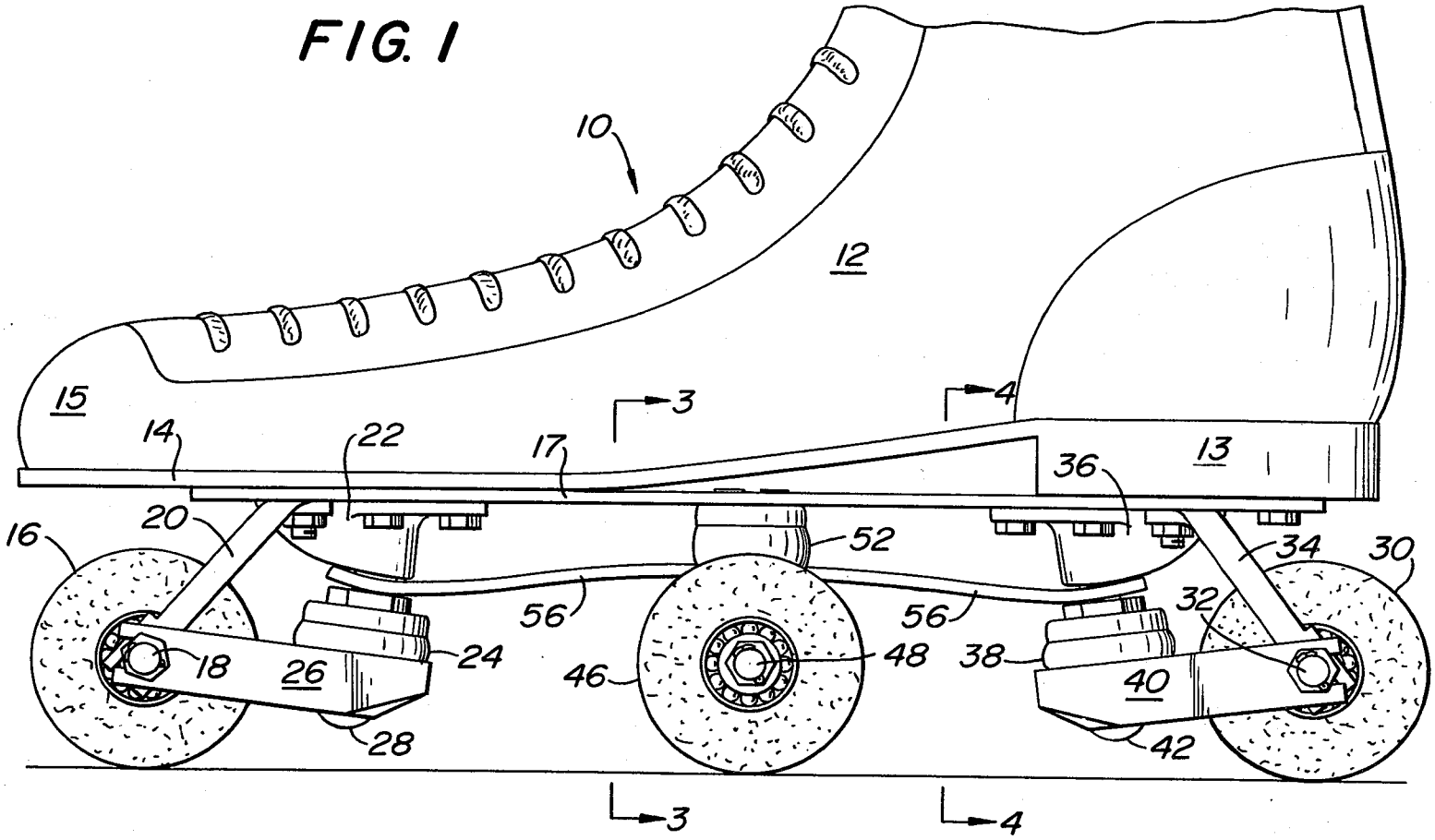
FIG. 1 is a side elevation view of the skate of the present invention.

Referring to the drawings in detail, wherein like numerals indicate like elements, there is shown in FIG. 1 a roller skate in accordance with the present invention designated generally as 10. The skate 10 includes a shoe for receiving therein a person's foot. The shoe 12 has laces to facilitate attaching the shoe in a conventional manner. The shoe 12 has a bottom outsole 14, a heel 13 and a toe 15.

A frame 17 is fixedly secured to the outsole 14 by use of conventional fasteners. A front wheel 16 is mounted on axle 18 by way of roller bearings. The axle 18 is supported by a front brace 20 which depends from and is secured to the frame 17.

A mount 22 is removably secured to the frame 17 at a location rearwardly of the front wheel 16. A schock absorber 24 and a fork 26 are attached to the mount 22 by a fastener 28. The fork 26 is generally U-shaped as shown more clearly in FIG. 2 and has its free ends attached to the axle 18, with fastener 28 extending through its bight portion. Shock absorber 24 is preferably a solid rubber shock absorber. It will be noted, as shown in FIG. 1, that the fastener 28 extends along an angle which is inclined with respect to the vertical by an angle of approximately 10° to 15°. Further, the shock absorber 24 is directly behind the front axle 18 at an elevation slightly below the longitudinal axis of axle 18.

Figure 2:
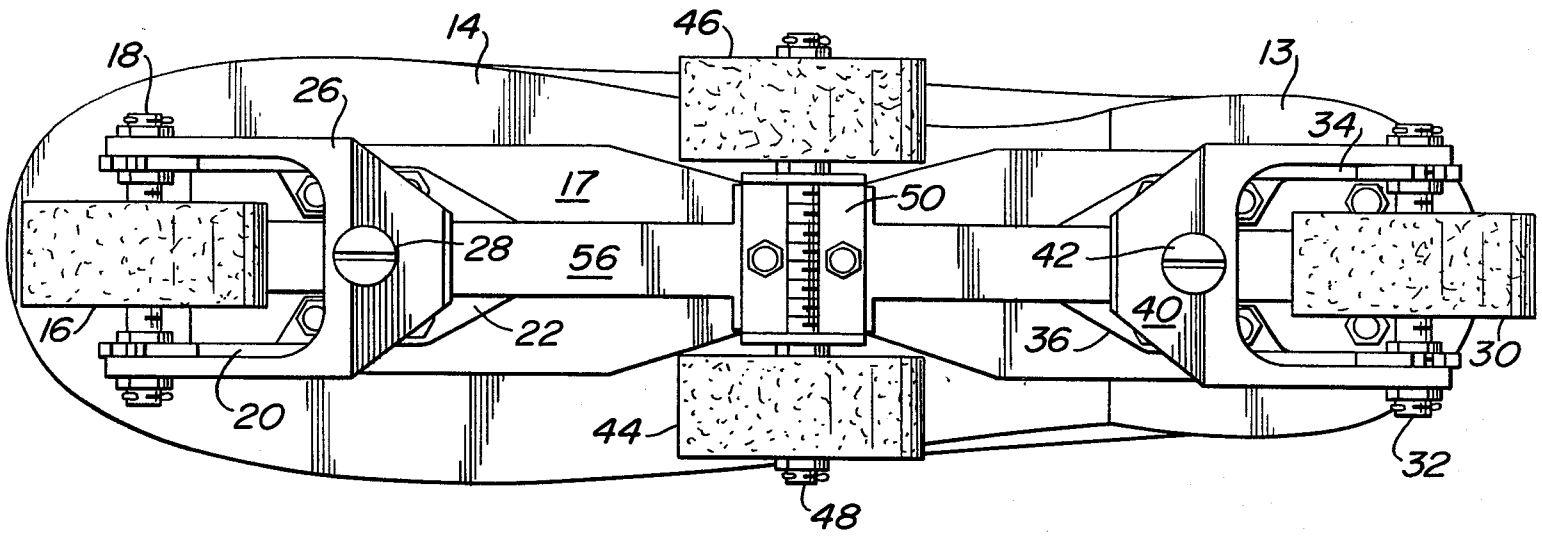
FIG. 2 is a bottom plan view of the skate of the present invention.

Referring to FIGS. 1 and 2, a rear wheel 30 is supported by roller bearings on axle 32. Rear wheel 30 is identical in size with front wheel 16 and is aligned therewith as shown more clearly in FIG. 2. Axle 32 is supported from the frame 17 by way of a depending brace 34. The rear brace 34 is the same as the front brace 20 but is angled in an opposite direction as will be apparent from FIG. 1.

A mount 36 is fixedly secured to the frame 17 beneath the heel 13. A fork 40 and rear shock absorber 38 are secured to the mount 36 by a fastener 42. Fork 40 is generally U-shaped with its legs rotatably supported by the axle 32 and with the fastener 42 extending through the bight of the fork 40. It will be noted that the axis of fastener 42 is inclined from the vertical by an angle of approximately 10° to 15°. The fastener 28 is inclined forwardly while the fastener 42 is inclined rearwardly. As shown in FIG. 1, the shock absorbers 24, 38 are at the same elevation.

Figure 3:
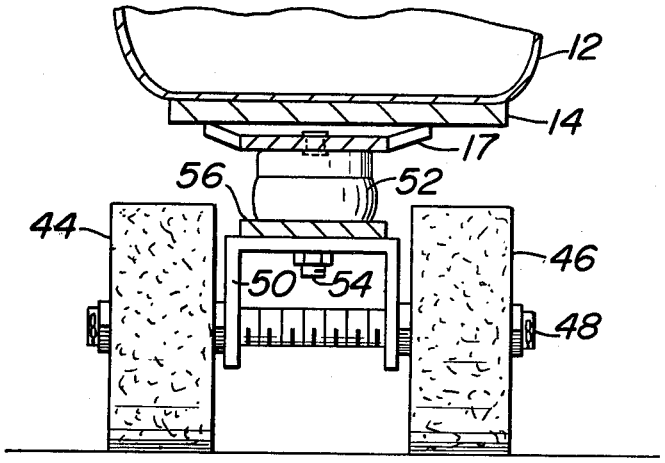
FIG. 3 is a sectional view taken along the line 3—3 in FIG. 1.
Figure 4:
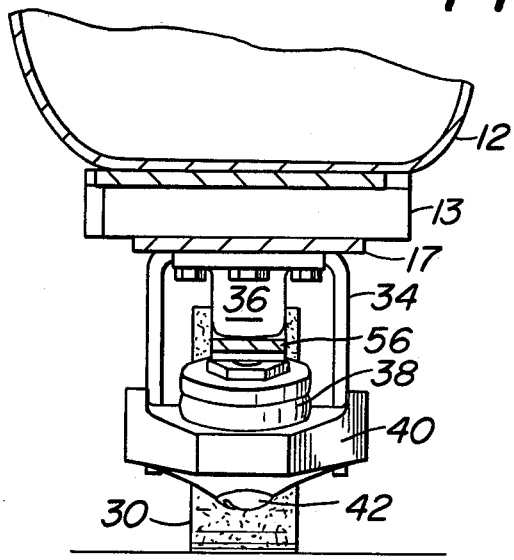
FIG. 4 is a sectional view taken along the line 4—4 in FIG. 1.

As shown more clearly in FIGS. 2 and 3, the shoe is provided with a pair of center balance wheels 44 and 46. The wheels 44, 46 are mounted on a common axle 48. All of the axles 18, 32, and 48 are at the same elevation. The wheels 44 and 46 are of the same size as the wheels 16 and 30 whereby all of the wheels will be in rolling contact with a support surface. Axle 48 is equidistant from the axles 16 and 32.

The axle 48 is supported from the frame 17 by a brace 50 and shock absorber 52 which are assembled to the frame 17 by way of a vertically disposed fastener 54. Shock absorber 52 is preferably made of rubber and subjected to slight compression forces. The shock absorbers 24 and 38 are deformed by compression forces applied to the respective fasteners 28, 42. Each of the shock absorbers 24, 52 and 38 has a metal cap at its upper end.

A balance arm 56 extends longitudinally along the frame 17 and is spaced therefrom. The forward end of the balance arm 56 is secured to the front mount 22 above the shock absorber 24 by the fastener 28. The rear end of the balance arm 56 is secured to the rear mount 36 above the shock absorber 38 by the fastener 42. The middle portion of the balance arm 56 is arched upwardly and is secured to the frame 17 below the shock absorber 52 by the fastener 54. The shock absorbers absorb the shocks which normally would be transmitted to the foot as a result of rough terrain while skating outdoors. The balance arm 56 helps transmit shock from one shock absorber to another.

The front wheel 16 transmits an initial shock vibration through fork 26 to shock absorber 24 where the shock vibration is partially absorbed and partially transmitted to balance arm 56. Arm 56 transmits the shock vibration to shock absorbers 52 and 38 for absorption thereby. Shock absorber 52 spaces arm 56 from plate 17 and absorbs some shock vibrations imparted to wheels 46.

As shown more clearly in FIG. 2, the front wheel 16 is centrally disposed beneath toe 15. Rear wheel 30 is centrally disposed beneath the heel 13. The wheels 16 and 30 are aligned with one another. The center balance wheels 44 and 46 are beneath the arch of the shoe 12 equidistant from the front and rear wheels 16, 30 respectively. Further, the wheels 44, 46 are equally spaced from the longitudinal axis of the shoe as shown in FIG. 2 and at the periphery of the sole 14.

Thus, there is provided in accordance with the present invention a roller skate for skating indoors or outdoors on rough terrain while at the same time having shock absorbers to minimize transmission of shock to the foot. Further, due to the particular arrangement of wheels all of which simultaneously are in rolling contact with the support surface, there is provided better balance and control so that one does not have the feeling of falling forward when hitting a crack or bump in the support surface.

The present invention may be embodied in other specific forms without departing from the spirit or essential attributes thereof and, accordingly, reference should be made to the appended claims, rather than to the foregoing specification, as indicating the scope of the invention.

I claim:

1. A roller skate comprising:

(a) a shoe for receiving therein a person's foot, said shoe having a bottom sole, (b) a frame fixedly attached to said bottom sole, a front wheel rotatably supported by a brace means depending from said frame adjacent to and beneath the toe of said shoe, a rear wheel rotatably supported by a brace means depending from said frame adjacent to and beneath the heel of said shoe, (c) a pair of center wheels rotatably supported on a common axis by a brace depending from said frame at a central location on said frame so that said common axis is substantially equidistant from the axes of rotation of said front and rear wheels, all of said wheels being of the same size and at the same elevation for simultaneous rolling contact with a support surface, said front and rear wheels being aligned with one another so as to be rotatable at a location along an imaginary center line of said sole, said center wheels being at opposite sides of said imaginary center line and beneath said sole, (d) a first shock absorber for said center wheels, a second shock absorber for said front wheel, and a third shock absorber for said rear wheel, means coupling said shock absorbers to said frame, said second shock absorber being rearwardly of the axle for the front wheel, said third shock absorber being forwardly of the axle for the rear wheel, a front fork extending from the front axle to said second shock absorber, a rear fork extending from said third shock absorber to the rear wheel axle.

2. A roller skate in accordance with claim 1 including a balance arm extending along said imaginary center line, fastener means securing said first shock absorber and a central portion of said balance arm to said frame, fastener means securing said second shock absorber and one end portion of said balance arm to said frame, fastener means securing the other end portion of said balance arm and said third shock absorber to said frame.

3. A roller skate in accordance with claim 2 including means connecting said balance arm to said frame so that the central portion of said balance arm is closer to said frame as compared with the end portions of said balance arm whereby said balance arm is arched.

4. A roller skate in accordance with claim 1 wherein the axis of said second shock absorber is angled forwardly at an angle of about 10° to 15° with respect to the vertical, said third shock absorber having its axis angled rearwardly at an angle of about 10° to 15° with respect to the vertical.

5. A roller skate in accordance with claim 1 wherein said second and third shock absorbers are at about the same elevation corresponding generally to the elevation of the axles for the front and rear wheels, said first shock absorber being above the axle for the center wheels and at an elevation above the elevation of the second and third shock absorbers.

6. A roller skate comprising a shoe, a single front wheel rotatably supported beneath and spaced from the toe of the shoe, a single rear wheel rotatably supported beneath and spaced from the heel of the shoe, a pair of center wheels rotatably supported and spaced from the arch of the shoe, the center wheels being on a common axle spaced substantially equidistant from the axes of rotation of front and rear wheels, all of said wheels being of the same size and at the same elevation for simultaneous rolling contact with a surface, the front and rear wheels being aligned with one another so as to be rotatable at a location along an imaginary center line of the sole of the shoe, said center wheels being on opposite sides of said imaginary center line adjacent the side edges of the sole of said shoe, shock absorber means for said wheels including a discrete shock absorber for each of the front and rear wheels and a common shock absorber for the center wheels, means connecting the axle for the front wheel and its shock absorber to the shoe at a location rearwardly of a vertical plane containing the axis of rotation of the front wheel, and means connecting the axle for the rear wheel and its shock absorber to the shoe at a location forwardly of a vertical plane containing the axis of rotation of the rear wheel.

7. A roller skate in accordance with claim 6 including a balance arm extending between said shock absorbers for transmitting shock from one shock absorber to another.

8. A roller skate in accordance with claim 7 wherein said balance arm is beneath the shock absorber for the center wheels andabove the shock absorbers for the front and rear wheels.

9. A roller skate in accordance with claim 7 wherein said balance arm is shorter than the distance between the axes of the front and rear wheels and centrally located between said axes.

10. A roller skate in accordance with claim 6 wherein said front and rear wheel shock absorbers are at about the same elevation corresponding generally to the elevation of the axles for the front and rear wheels, said common shock absorber being above the axle for the center wheels and at an elevation above the elevation of the second and third shock absorbers.

* * * * *